US007006785B2

(12) United States Patent
Embry

(10) Patent No.: US 7,006,785 B2
(45) Date of Patent: Feb. 28, 2006

(54) METERING NIP FOR MOVING A MEDIA SHEET WITHIN AN IMAGE FORMING DEVICE

(75) Inventor: Kerry Leland Embry, Midway, KY (US)

(73) Assignee: Lexmark International, Inc., Lexington, KY (US)

( * ) Notice: Subject to any disclaimer, the term of this patent is extended or adjusted under 35 U.S.C. 154(b) by 22 days.

(21) Appl. No.: 10/808,055

(22) Filed: Mar. 24, 2004

(65) Prior Publication Data

US 2005/0214048 A1 Sep. 29, 2005

(51) Int. Cl.
*G03G 15/14* (2006.01)
*G03G 15/00* (2006.01)

(52) U.S. Cl. ..... 399/388; 399/390; 399/395; 399/396

(58) Field of Classification Search ..... 399/388, 399/390, 395, 396
See application file for complete search history.

(56) References Cited

U.S. PATENT DOCUMENTS

| | | | | | |
|---|---|---|---|---|---|
| 4,849,795 | A | | 7/1989 | Spehrley, Jr. et al. | |
| 5,050,859 | A | | 9/1991 | Paxon | |
| 5,166,735 | A | * | 11/1992 | Malachowski | 399/68 |
| 5,368,289 | A | | 11/1994 | Iwaki et al. | |
| 5,455,604 | A | * | 10/1995 | Adams et al. | 346/138 |
| 5,543,909 | A | * | 8/1996 | Quesnel | 399/394 |
| 5,559,575 | A | | 9/1996 | King | |
| 5,568,244 | A | | 10/1996 | Hirai et al. | |
| 5,678,127 | A | * | 10/1997 | Suga | 399/45 |
| 5,821,968 | A | | 10/1998 | Ohyama et al. | |
| 5,946,540 | A | | 8/1999 | Harada et al. | |
| 6,055,409 | A | * | 4/2000 | Richards et al. | 399/388 |
| 6,234,472 | B1 | | 5/2001 | Juan | |
| 6,293,535 | B1 | | 9/2001 | Pfankuch | |
| 6,302,391 | B1 | | 10/2001 | Robert | |
| 6,322,069 | B1 | | 11/2001 | Krucinski et al. | |
| 6,405,850 | B1 | | 6/2002 | Jackson et al. | |
| 6,491,492 | B1 | | 12/2002 | Cook | |
| 6,567,643 | B1 | * | 5/2003 | Yasui et al. | 399/391 |
| 6,775,486 | B1 | * | 8/2004 | Matsuyama et al. | 399/21 |
| 6,834,853 | B1 | * | 12/2004 | Trovinger et al. | 271/227 |
| 6,836,641 | B1 | * | 12/2004 | Uchida et al. | 399/396 |

* cited by examiner

*Primary Examiner*—Andrew H. Hirshfeld
*Assistant Examiner*—Marvin P. Crenshaw
(74) *Attorney, Agent, or Firm*—Coats & Bennett, PLLC

(57) ABSTRACT

A method and device for moving media sheets along a media path. In one embodiment, the media path comprises a metering nip, at least one transfer nip downstream from the metering nip, and a feed nip upstream from the metering nip. The feed nip moves the media sheet initially at a faster speed than the metering nip. This speed variation causes a buckle to form in the media sheet that aligns the leading edge. The media sheet is then moved from the metering nip into the transfer nip. The metering nip may move the media sheet at a faster speed than the transfer nip again forming a buckle in the media sheet. As the media sheet is moved through the transfer nip, it is tacked to a transfer belt such that it moves consistently through the remaining downstream transfer nips.

20 Claims, 4 Drawing Sheets

METERING NIP FOR MOVING A MEDIA SHEET WITHIN AN IMAGE FORMING DEVICE

BACKGROUND

Media sheets are moved through an image forming device by a series of rollers and/or belts. In a monochromatic device, the media sheet is moved along a media path past one photoconductive member that forms an image on the sheet with a single toner layer, usually in black toner. In a color device, the media sheet is moved along the media path past a number of photoconductive members that each form a different color toner layer on the sheet. The toner layers are place in an overlapping arrangement and usually include black, yellow, magenta, and cyan toner. The combination of different layers forms a wide spectrum of color images. It is important that the media sheet is accurately moved through the device during the image formation process.

The media sheet should be aligned properly while moving along the media path. A media sheet is aligned if, when crossing a line across the media path perpendicular to the direction of travel, the leading edge encounters the line at the same time along its extent. A media sheet is skewed if, for example, when crossing such a line, one of the leading corners of the media sheet encounters the line before the other leading corner. The toner layers will be placed in a skewed configuration if the media sheet is not properly aligned when moving past the photoconductive members. This results in non-uniform margins along the edges of the printed media sheet.

Another concern for color image forming devices is the media sheet being accurately located while moving past each of the photoconductive members. When the sheet is accurately located, each toner layer is accurately aligned with the other toner layers resulting in a clear color image. If the media sheet is not properly located, one or more of the toner layers will be offset from the other toner layers. This results in a ghosting effect that is of unacceptable quality.

The image forming devices should also be able to produce an acceptable number of printed images per minute. This is important because many consumers base their purchasing decision on the printing speed of the device. Therefore, any methods and devices that prevent media and toner misalignment should not greatly adverse the throughput of the device.

SUMMARY

The present invention is directed to a method and device for moving media sheets along a media path. In one embodiment, the media path comprises a metering nip, at least one transfer nip downstream from the metering nip, and a feed nip upstream from the metering nip. The media sheet is initially moved through the feed nip and into the metering nip. The feed nip moves the media sheet initially at a faster speed than the metering nip. This speed variation causes a buckle to form in the media sheet that aligns the leading edge. The media sheet is then moved from the metering nip into the transfer nip. The metering nip may move the media sheet at a faster speed than the transfer nip again forming a buckle in the media sheet. As the media sheet is moved through the transfer nip, it is tacked to a transfer belt such that it moves consistently through the remaining downstream transfer nips.

DETAILED DESCRIPTION

Figure 1:
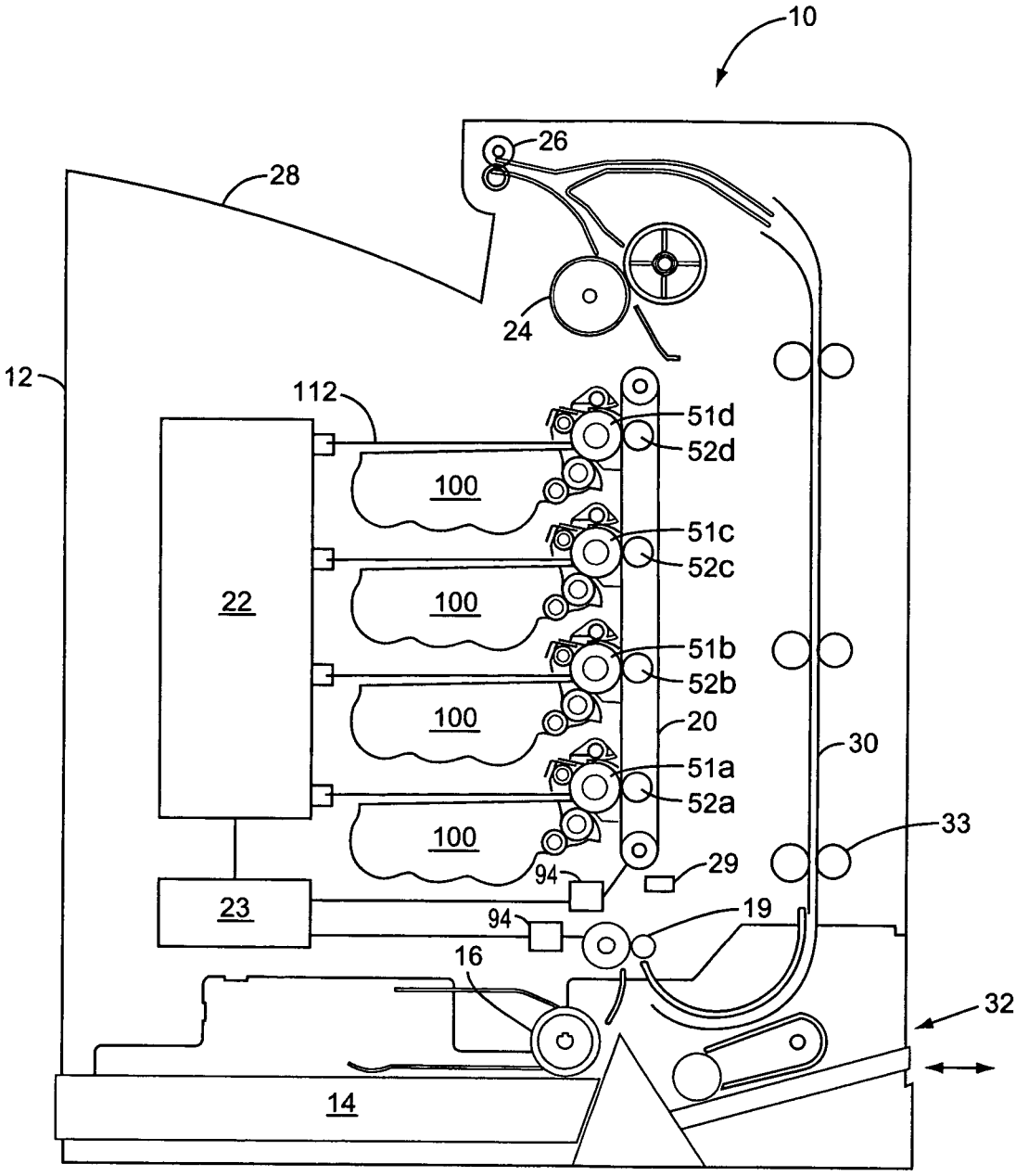
FIG. 1 is a schematic view of an image forming device constructed according to one embodiment of the present invention.

FIG. 1 depicts a representative image forming device, such as a printer, indicated generally by the numeral 10. The image forming device 10 comprises a main body 12. A media tray 14 with a pick mechanism 16, or a manual input 32 are conduits for introducing media sheets into the device 10. The media tray 14 is preferably removable for refilling, and located on a lower section of the device 10.

Media sheets are moved from the input and fed into a primary media path. A controller 23 oversees the movement of the media sheets and the image formation process. A metering nip 19 disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

A toner image on the photoconductive members 51 is transferred to the media sheet as it moves along the transport belt 20. The media sheet with loose toner is then moved through a fuser 24 that adheres the toner to the media sheet. Exit rollers 26 rotate in a forward or a reverse direction to move the media sheet to an output tray 28 or a duplex path 30. The duplex path 30 directs the inverted media sheet back through the image formation process for forming an image on a second side of the media sheet.

The position of the media sheet M as it moves along the media path is tracked by the controller 23. Controller 23 is responsible for the timing of the media sheet and the image formation process. The controller 23 includes logic circuitry to control the operation of the image forming device 10 according to program instructions stored in memory. The controller 23 may comprise, for example, a single microcontroller or microprocessor. Alternatively, two or more such devices may implement the functions of the controller 23. The controller 23 may be incorporated within a custom integrated circuit or application specific integrated circuit (ASIC).

In one embodiment, motors 94 that drive sections of the media path are stepper motors operatively connected to the controller 23. Each revolution of the stepper motor equates to the media sheet M moving a predetermined distance along the media path. Controller 23 tracks the location of the media sheet by tracking the motor revolutions. Another embodiment features motors 94 being DC motor with an encoder wheel with the controller 23 tracking encoder pulses or counts to determine the location of the media sheet M. In another embodiment, sensors 29 are positioned along the media path to sense the leading and/or trailing edge of the media sheet as it moves along the media path. Sensors may include an emitter that emits a light beam across the media path, and a receiver that receives the light beam. As the media sheet moves past the sensor the media sheet prevents or reduces the receiver from receiving the light beam. This is signaled to the controller 23 and interpreted as the location of the media sheet. In another sensor embodiment, a pivoting arm extends across a section of the media path and is pivoted when the media sheet moves past. The pivoting motion of the arm is again signaled to the controller 23 to track the media sheet location.

The media sheet should be accurately aligned as passes through the transfer nips 80, 81, 82, 83. Additionally, the media sheet M should be firmly positioned on the transfer belt 20 as it moves through each of the transfer nips 80, 81, 82, 83 to ensure proper overlapping of the different toner layers. Proper alignment is achieved as the media sheet moves from the pick mechanism 16 through the metering nip 19. In FIGS. 2–6, the media sheet is illustrated as moving from the input tray 14 by the pick mechanism 16 and into the metering nip 19. It is understood that the same methods are used as the media sheet moves through the duplex path 30 with the feed nip 33 directing the media sheet into the metering nip 33.

Figures 2, 3, 4:
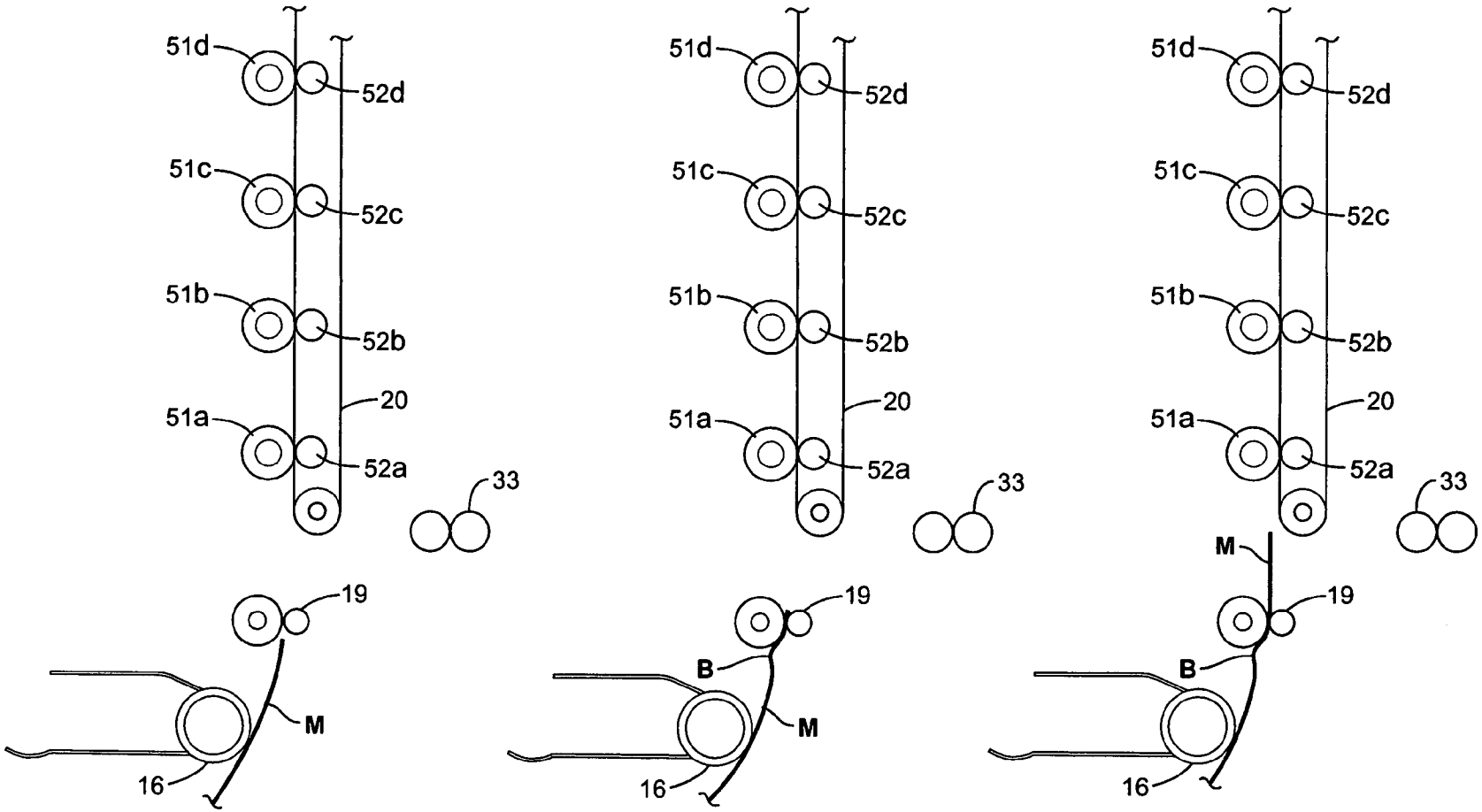
FIGS. 2–6 are a progression of schematic views illustrating a media sheet moving along the media path through the feed nip, metering nip, and a plurality of transfer rolls according to one embodiment of the present inventions.

FIG. 2 illustrates the media sheet M moving from the input tray 14 by the pick mechanism 16. The speed of the media sheet M is controlled by the pick mechanism 16. The metering nip 19 is either rotating in a reverse direction or is stopped as the leading edge of the media sheet M approaches. As illustrated in FIG. 3, the difference is speeds between the metering nip 19 and the pick mechanism 16 causes a buckle B to be formed in the media sheet M upstream from the metering nip 19 when the leading edge of the media sheet M contacts the metering nip 19. The buckle B aligns the media sheet M as it moves through the metering nip causing the leading edge to encounter the metering nip 19 at the same time along its extent. After a predetermined period of time after the leading edge contact, metering nip 19 is rotated in a forward direction to move the media sheet M through the metering nip 19.

After the buckle B is formed, the metering nip 19 may drive the media sheet M at a faster speed, slower speed, or the same speed as the pick mechanism 16 as the media sheet M is moved towards the transport belt 20 as illustrated in FIG. 4. If the metering nip 19 is driven at a slower speed or the same speed as the pick mechanism 16, buckle B will increase or remain at the same size, respectively. If driven at a faster speed, the buckle B will dissipate. In one embodiment, the metering nip 19 is driven at a faster speed than the pick mechanism 16, but not at such a rate that the buckle B is completely dissipated by the time the trailing edge moves through the metering nip 19. In one specific embodiment with the device 10 operating at about twenty pages per minute, the pick mechanism 16 rotates at a surface speed of about 3.9 mm/s, and the metering nip 19 rotates at a surface speed of about 3.4 mm/s.

Figure 5:
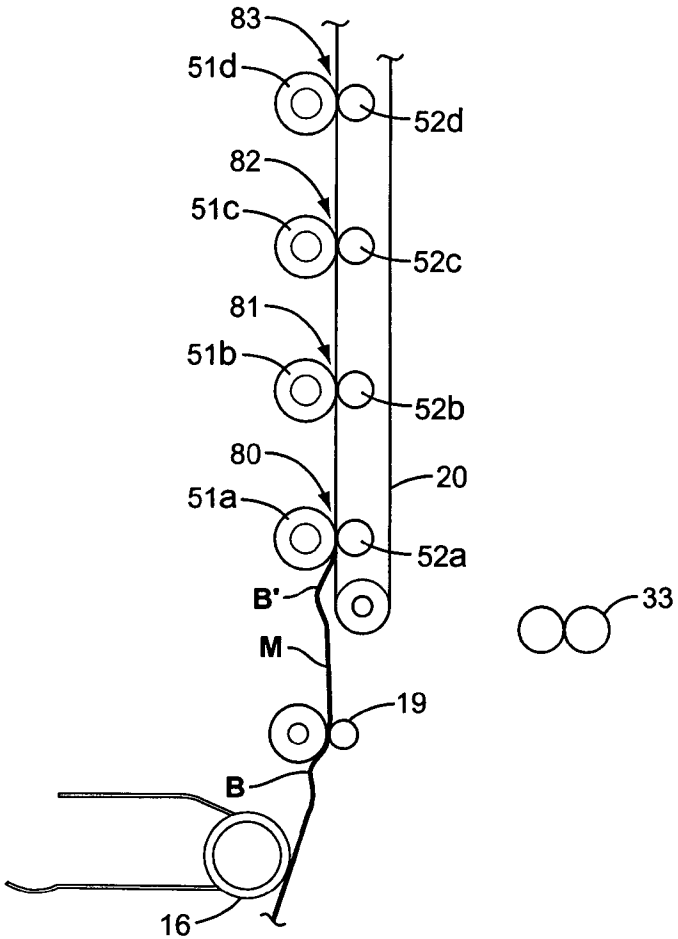

As illustrated in FIG. 5, the metering nip 19 moves the media sheet M at a faster speed than the first transfer nip 80 formed between photoconductive member 51*a* and transfer roll 52*a*. A second buckle B' is formed immediately upstream from the first transfer nip 80. In one embodiment, the metering nip 19 rotates at a speed about 0.1–3% faster than the first transfer nip 80. In one embodiment with the device 10 operating at about twenty pages per minute, the metering nip 19 rotates at a surface speed of about 3.44 mm/s and the first transfer nip 80 rotates at a surface speed of about 3.42 mm/s. This speed differential causes the sheet M to be in a slackened state as it enters the first transfer nip 80 and prevents the media sheet M from being in tension as it moves through the first transfer nip 80. If the metering nip 19 rotated at a slower speed than the first transfer nip 80, the media sheet M would be in tension while moving through the first transfer nip 80 that may result in the media sheet sliding on the transport belt 20. The controller 23 cannot accurately track the location of the media sheet M if it slides on the transport belt 20. This results in one or more of the toner layers applied at the transfer nips 80, 81, 82, 83 being offset resulting in a print defect. In one embodiment, the transport belt 20, and the transfer nips 80, 81, 82, 83 each move at approximately the same speed. In one embodiment, each has a surface speed of about 3.42 mm/s when the device 10 operates at about twenty pages per minute. In one embodiment, the transfer nips 80, 81, 82, 83 are each spaced about 50 mm apart.

Figure 6:
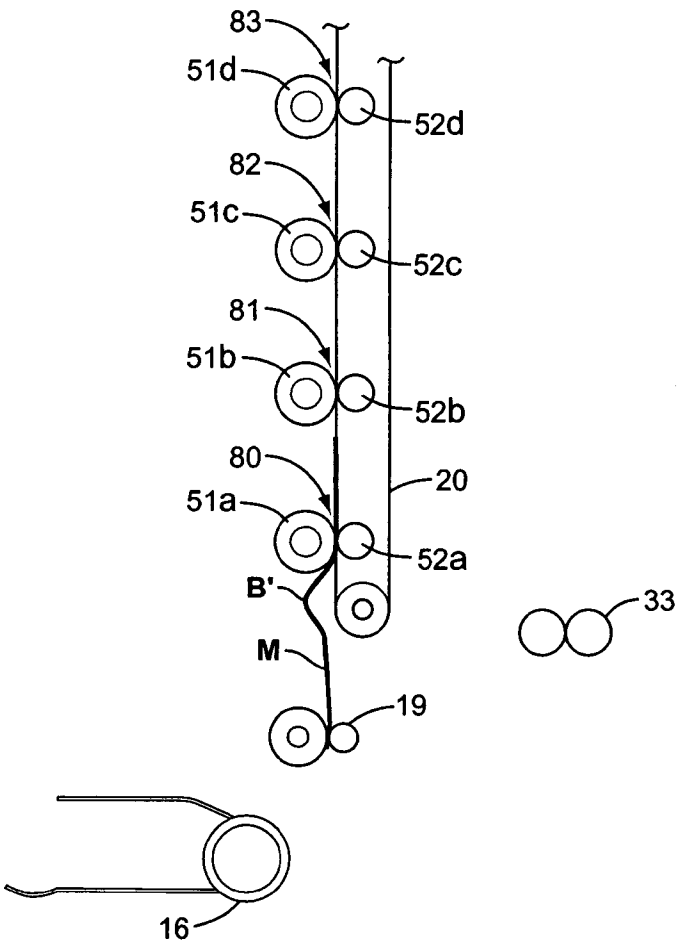

The media sheet M is not adhered to the transport belt 20 until passing through the first transfer nip 80. In one embodiment, the first transport nip 80 is positioned along the transport belt 20 away from a leading edge of the belt. The second buckle B' allows the first transfer nip 80 to control the placement of the media sheet M onto the transport belt 20. The first transfer nip 80 electrostatically adheres the media sheet M to the transport belt 20. Once the media sheet M is properly adhered, it maintains the same relative position on the belt 20 as it moves through the remaining transfer nips 81, 82, 83 to ensure proper placement of the remaining toner layers as illustrated in FIG. 6. Further, the controller 23 can accurately track the location of the media sheet M.

Figure 7:
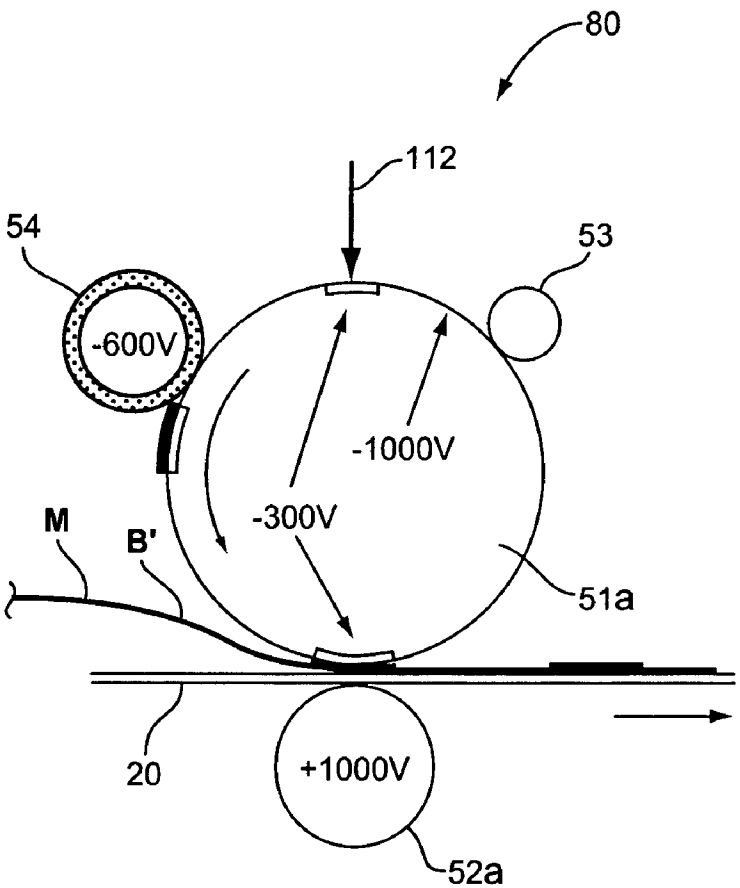
FIG. 7 illustrates a media sheet moving through the first transfer nip according to one embodiment of the present invention.

FIG. 7 illustrates the media sheet M moving through the first transfer nip 80. A charging unit 53 charges the surface of the photoconductive member 51*a* to approximately −1000 v. A laser beam 112 discharges areas on the photoconductive member 51*a* to form a latent image on the surface of the photoconductive member 51*a*. The areas of the photoconductive member 51*a* illuminated by the laser beam 112 are discharged to approximately −300 v. The photoconductive member core is held at −200 v. A developer roll 54 transfers negatively-charged toner having a core voltage of approximately −600 v to the surface of the photoconductive member 51*a* to develop the latent image on the photoconductive member 51*a*. The toner is attracted to the most positive surface, i.e., the area discharged by the laser beam 112. As the photoconductive member 51*a* rotates, a positive voltage field produced by the transfer roller 52*a* attracts and transfers the toner on the photoconductive member 51*a* to the media sheet M.

The media sheet M electrostatically adheres to the transport belt 20 after moving through the first media nip 80. Voltages used for the transfer of toner are also adequate for tacking the media sheet M to the belt. The term "tacking" is used to denote electrostatically attaching the media sheet M to the transport belt 20. In one embodiment, the pressure exerted between the photoconductive member 51*a* and the transfer roller 52*a* assists in tacking the media sheet M to the belt. In another embodiment, a tack-roller may be added along the transport belt 20 to assist in tacking the media sheet.

In the embodiment illustrated in FIGS. 4 and 5 is can be seen that the media sheet M is moved a distance along the transport belt 20 prior to being tacked. The media sheet M may or may not be in contact with the transport belt 20 prior to moving through the first transfer nip 80. The media sheet M is moved by the metering nip 19 during this time. In one embodiment, the distance between the metering nip 19 and the first transfer nip 80 is about 64 mm.

The term "image forming device" and the like is used generally herein as a device that produces images on a media sheet M. Examples include but are not limited to a laser printer, ink-jet printer, fax machine, copier, and a multi-functional machine. One example of an image forming device is Model No. C750 referenced above.

The term "imaging device" refers to a device that arranges an electrical charge on the photoconductive element. Various imaging devices may be used such as a laser printhead and a LED printhead.

The term "driving device" refers to a device for moving the media sheet through the image forming device 10. Specific embodiments include nip rollers, such as the metering nip 19, that include a pair of rollers spaced a distance apart to form a nip through which the media sheet is driven, and a single roller, such as the pick mechanism 16, which includes a roller spaced from a surface.

The present invention may be carried out in other specific ways than those herein set forth without departing from the scope and essential characteristics of the invention. The transfer rollers 52*a*, 52*b*, 52*c*, 52 may include a roll, a transfer corona, transfer belt, or multiple transfer devices, such as multiple transfer rolls. In one embodiment, the first transfer nip 80 transfers a black toner image to the media sheet. The present embodiments are, therefore, to be considered in all respects as illustrative and not restrictive, and all changes coming within the meaning and equivalency range of the appended claims are intended to be embraced therein.

What is claimed is:

1. A method of moving a media sheet through an image forming device comprising the steps of:

rotating a first driving device and moving the media sheet through the first driving device;

forming a buckle in the media sheet as a leading edge contacts a second driving device;

rotating the second driving device and moving the media sheet through the second driving device;

rotating the second driving device at a first speed and moving the media sheet into a transfer nip;

rotating the transfer nip at a second speed slower than the first speed and forming a second buckle in the media sheet;

moving the media sheet through the transfer nip and electrostatically tacking the media sheet to the transport belt; and moving the transport belt and moving the media sheet through at least one downstream transfer nip while adhered to the transport belt.

2. The method of claim 1, further comprising rotating the second driving device in a reverse direction when the leading edge contacts the second driving device.

3. The method of claim 1, further comprising contacting the leading edge against the second driving device when the second driving device is stationary.

4. The method of claim 1, comprising concurrently driving the media sheet in the second driving device and the transfer nip.

5. The method of claim 4, further comprising maintaining the media sheet in a slackened state while moving through the transfer nip.

6. The method of claim 1, further comprising transferring a toner image to the media sheet at the transfer nip.

7. The method of claim 1, further comprising moving the media sheet a distance along the transport belt before electrostatically tacking the media sheet to the transport belt.

8. A method of moving a media sheet through an image forming device comprising the steps of:

moving the media sheet through a first driving device;

forming a buckle in the media sheet at a transfer nip by contacting a leading edge of the media sheet with the transfer nip; and transferring a toner image to the media sheet at the transfer nip and simultaneously electrostatically tacking the media sheet to a transport belt.

9. The method of claim 8, further comprising rotating the transport belt and moving the media sheet through a downstream transfer nip and overlapping a second toner image of a different color over the toner image.

10. The method of claim 9, further comprising positioning the media sheet in a slackened state while moving through the transfer nip.

11. The method of claim 8, wherein the step of transferring a toner image to the media sheet at the transfer nip comprises transferring a black toner image to the media sheet.

12. The method of claim 8, further comprising moving the media sheet a distance along the transport belt prior to moving the media sheet through the transfer nip.

13. A method of moving a media sheet through an image forming device comprising the steps of:

positioning the media sheet in a slackened state and moving the media sheet through a metering nip;

moving the media sheet through the metering nip to a transfer nip;

positioning the media sheet in the slackened state and moving the media sheet through the transfer nip;

while moving through the transfer nip, transferring a toner image to the media sheet; and while moving through the transfer nip, electrostatically tacking the media sheet to a transport belt.

14. The method of claim 13, further comprising maintaining a position of the media sheet relative to the transport belt and transferring a second color toner image to the media sheet as the media sheet and transport belt are moving through a second transfer nip.

15. A method of moving a media sheet through an image forming device comprising the steps of:

rotating a first driving device in a forward direction and moving the media sheet through the first driving device;

forming a buckle in the media sheet as a leading edge contacts a metering nip;

rotating the metering nip in the forward direction and moving the media sheet through the metering nip;

rotating the metering nip at a first speed and moving the media sheet to a first transfer nip;

rotating the first transfer nip at a second speed slower than the first speed while moving the media sheet through the first transfer nip and forming a second buckle in the media sheet;

while moving the media sheet through the first transfer nip, transferring a toner image in a first color to the media sheet;

while moving the media sheet through the first transfer nip, electrostatically tacking the media sheet to the transport belt; and maintaining a position of the media sheet relative to the transport belt and transferring a second toner image in a second color to the media sheet as the media sheet and transport belt are moving through a second transfer nip.

16. The method of claim 15, wherein the step of transferring the toner image in the first color to the media sheet, comprises transferring a black image to the media sheet.

17. The method of claim 15, wherein the step of rotating the first driving device in the forward direction and moving the media sheet through the first driving device comprises picking the media sheet from an input tray.

18. The method of claim 15, wherein the step of rotating the first driving device in the forward direction and moving the media sheet through the first driving device comprises moving the media sheet through a duplex path back towards a primary imaging path.

19. A method of moving a media sheet through an image forming device comprising the steps of:

forming a first buckle in the media sheet as it moves through a first roller;

forming a second buckle in the media sheet as it is moved by the first roller into a transfer nip;

electrostatically tacking the media sheet to a transport belt as the media sheet is moving through the transfer nip; and transferring a toner image to the media sheet as the media sheet is moving through the transfer nip.

20. The method of claim 19, further comprising moving the media sheet a distance along the transport belt prior to electrostatically tacking the media sheet to the transport belt.

* * * * *